US011766161B2

(12) United States Patent
Held et al.

(10) Patent No.: US 11,766,161 B2
(45) Date of Patent: Sep. 26, 2023

(54) CONTAINER HOLDER, CROCKERY BASKET AND DOMESTIC DISHWASHER

(71) Applicant: BSH Hausgeräte GmbH, Munich (DE)

(72) Inventors: Martin Held, Niederstotzingen (DE); Christian Jakob, Lauingen (DE); Martin Siddiqui-Baeumert, Kronberg (DE)

(73) Assignee: BSH Hausgeräte GmbH, Munich (DE)

( * ) Notice: Subject to any disclaimer, the term of this patent is extended or adjusted under 35 U.S.C. 154(b) by 53 days.

(21) Appl. No.: 17/609,799

(22) PCT Filed: May 27, 2020

(86) PCT No.: PCT/EP2020/064665
§ 371 (c)(1),
(2) Date: Nov. 9, 2021

(87) PCT Pub. No.: WO2020/239819
PCT Pub. Date: Dec. 3, 2020

(65) Prior Publication Data

US 2022/0240750 A1 Aug. 4, 2022

(30) Foreign Application Priority Data

May 28, 2019 (DE) ..... 10 2019 207 812.5

(51) Int. Cl.
*A47L 15/50* (2006.01)

(52) U.S. Cl.
CPC ..... *A47L 15/505* (2013.01); *A47L 15/503* (2013.01)

(58) Field of Classification Search
CPC ..... A47L 15/50; A47L 15/503; A47L 15/505; A47L 19/04
See application file for complete search history.

(56) References Cited

U.S. PATENT DOCUMENTS 4,828,211 A 5/1989 McConnell
4,887,784 A * 12/1989 Kayali ..... F16M 13/022 248/231.51
5,014,956 A * 5/1991 Kayali ..... B60N 3/106 248/311.2
5,072,909 A * 12/1991 Huang ..... B60N 3/102 248/316.4

(Continued)

FOREIGN PATENT DOCUMENTS

CN 204363929 U 6/2015
CN 108542330 A 9/2018

(Continued)

OTHER PUBLICATIONS

Report of Examination DE 10 2019 207 812.5 dated Jun. 3, 2020.
International Search Report PCT/EP2020/064665 dated Jul. 31, 2020.

*Primary Examiner* — Patrick D Hawn
(74) *Attorney, Agent, or Firm* — Michael E. Tschupp; Andre Pallapies; Brando G. Braun

(57) ABSTRACT

A container holder for a dish basket of a household dishwasher includes a holding device, which has a holding position for holding a container and a downwardly inclined position relative to the container. The holding device is designed to move out from the holding position into the inclined position when a vertical, downwardly directed force is exerted on the holding device and exceeds a threshold value.

13 Claims, 11 Drawing Sheets

(56) References Cited

U.S. PATENT DOCUMENTS

| | | | | | |
|---|---|---|---|---|---|
| 5,249,590 | A * | 10/1993 | Jacobus | A47L 15/505 | 134/201 |
| 5,342,009 | A * | 8/1994 | Lehner | A47G 23/0225 | 248/311.2 |
| 6,047,937 | A * | 4/2000 | Huang | B60N 3/102 | 248/312.1 |
| 6,123,204 | A | 9/2000 | Nelson | | |
| 7,458,471 | B2 * | 12/2008 | Crudgington, Jr. | A47L 15/505 | 211/41.9 |
| 9,179,819 | B2 * | 11/2015 | Ryu | A47L 15/505 | |
| 9,241,554 | B1 * | 1/2016 | Tong | A45C 13/00 | |
| 10,531,755 | B1 * | 1/2020 | Huang | F16B 2/12 | |
| 11,547,230 | B2 * | 1/2023 | Hsu Besner | A47G 23/0225 | |
| 2006/0138064 | A1 | 6/2006 | Crudgington, Jr. | | |
| 2008/0149149 | A1 | 6/2008 | Ryu | | |
| 2011/0192808 | A1 | 8/2011 | Buhl | | |

FOREIGN PATENT DOCUMENTS

| | | | | |
|---|---|---|---|---|
| DE | 102014226808 | A1 | 6/2016 | |
| DE | 102018103585 | A1 | 9/2018 | |
| EP | 2036482 | A1 | 3/2009 | |
| EP | 2095755 | A1 * | 9/2009 | A47L 15/503 |
| EP | 3037028 | A1 | 6/2016 | |

* cited by examiner

CONTAINER HOLDER, CROCKERY BASKET AND DOMESTIC DISHWASHER

CROSS-REFERENCES TO RELATED APPLICATIONS

This application is the U.S. National Stage of International Application No. PCT/EP2020/064665, filed May 27, 2020, which designated the United States and has been published as International Publication No. WO 2020/239819 A1 and which claims the priority of German Patent Application, Serial No. 10 2019 207 812.5, filed May 28, 2019, pursuant to 35 U.S.C. 119(a)-(d).

The contents of International Application No. PCT/EP2020/064665 and German Patent Application, Serial No. 10 2019 207 812.5 are incorporated herein by reference in their entireties as if fully set forth herein.

BACKGROUND OF THE INVENTION

The present invention relates to a container holder for a dish basket. The present invention furthermore relates to a dish basket for a household dishwasher with a container holder of this type. Additionally, the present invention relates to a household dishwasher with a container holder of this type or a dish basket of this type.

A household dishwasher has a dishwasher cavity and at least one dish basket which can be moved into or out of the dishwasher cavity. The household dishwasher can have a number of dish baskets which are arranged one above the other, such as for instance a bottom basket, a top basket, and a cutlery drawer. A bottle holder can also be provided within the dish basket.

Publication CN 204363929 U discloses for example a bottle holder with a plate, which can be fastened to a side wall of a dish basket. Furthermore, two ring elements can be fastened to the plate in order to receive a bottle therein. The ring elements can be folded away in an upward direction.

BRIEF SUMMARY OF THE INVENTION

Against this background, an object of the present invention consists in providing an improved container holder for a dish basket.

Accordingly, a container holder for a dish basket of a household dishwasher is proposed. The container holder comprises a holding device, which has a holding position for holding a container and a position which is downwardly inclined relative thereto, wherein the holding device is designed, when a vertical, downwardly directed force is exerted thereon, to move out from the holding position into the inclined position when the force exceeds a threshold value.

This has the advantage that an excessive deformation or a breakage of the holding device or of the container holder can be avoided. In this way, an overload protection is provided. A durable container holder can thus be provided. The container holder is designed to hold the holding device in the holding position, in particular with the aid of a form closure, as long as the force remains below the threshold value. When the threshold value is exceeded, the form closure is preferably released or unlocked so that the holding device moves into the inclined position. Such a release or unlocking of the form closure can be associated for example with an unlatching.

The container holder is for example a bottle holder. A container is for example an elongated container for storing a liquid. The container or a part thereof is preferably rotationally symmetrical. The container is for example a decanter, a bottle, a sports bottle or a feeding bottle. In particular, the holding device is designed to grip around the container. The force is for example a force which a user exerts onto the holding device. The holding device preferably has a positive angle to a horizontal in the holding position. The holding device is then inclined upward, for example. In the downwardly inclined position, this angle is negative. In particular, the holding device is formed from plastic. The container holder is preferably formed from plastic.

The holding position is for example the position of use of the holding device. The holding device preferably comprises a ring element. The ring element comprises in particular an opening through which the container can be guided. The ring element is designed for example to center the container and/or to secure it to one side from falling out of the container holder. Inclined position means here that a ring plane of the ring element is inclined relative to a horizontal. The downwardly inclined position can be referred to for example as the through-latching position. The holding device can be moved at any time back out of the downwardly inclined position into the holding position. The force is preferably applied to an outermost free end of the ring element. This results in the greatest possible lever on the fastening element. The force preferably amounts to between 1 and 200 N, 2 and 100 N, 3 and 80 N, 5 and 40 N or 10 and 30 N. The force can also be applied to another point of the ring segment, wherein the threshold value is then greater on account of the smaller lever.

According to one embodiment, the container holder comprises a base body on which the holding device is rotationally mounted.

The movement of the holding device is thus a rotational movement. The holding device preferably comprises a fastening element, which comprises two bearing pins projecting in opposite directions. In particular, the base body comprises bearings, in particular bearing points, for each bearing pin. The bearing pins and the bearings are preferably embodied as a clip connection. For example, the bearing pins snap into the bearings when the holding device is pushed onto the base body. The bearing pins and the bearings define an axis of rotation of the holding device relative to the base body. In particular, the base body is formed from plastic.

According to a further embodiment, the holding device has an upwardly folded position relative to the holding position.

The holding device thus has at least three positions. In particular, the upwardly folded position can also be referred to as the folded-in position. This advantageously makes it possible to realize a space-saving position of the container holder so that more space is available for other dishware in the dish basket. The holding device preferably has a vertical alignment in the upwardly folded position.

According to a further embodiment, the holding device is preferably pretensioned against the base body in the upwardly folded position.

Advantageously, the holding device is thus fixed in the upwardly folded position so that an undesired movement into the holding position can be avoided. A lower force is preferably required to overcome this pretensioning than to exceed the threshold value.

According to a further embodiment, the base body has a projection and the holding device has a contour, wherein the contour slides at least in sections over the projection when the holding device rotates relative to the base body.

When the holding device is rotated, this is also associated with a rotational movement of the contour. In particular, the holding device has a cam, which comprises the contour. The cam is embodied for example on the fastening element of the holding device. The contour and the projection preferably embody a form-fit connection when the holding device is in the holding position. In particular, the contour presses against the projection on account of a gravitational force acting on the ring element and a lever effect when the holding device is in the holding position. The projection prevents the holding device from moving into the downwardly inclined position. Advantageously, the threshold value can be set with the aid of the contour and the projection.

According to a further embodiment, the contour comprises a first elevation, which presses against the projection and prevents a rotation of the holding device in the direction of the inclined position when the holding device is in the holding position and the force is below the threshold value.

The pressing is for example a resting of the elevation on the projection. The elevation and the projection embody a form-fit connection which prevents the holding device from rotating out of the holding position into the downwardly inclined position. This advantageously enables a robust mechanical design to be provided in order to enable the different positions of the holding device. The first elevation is preferably embodied on the cam.

According to a further embodiment, the holding device and the base body are designed in such a way that the projection and/or the first elevation performs an evasive movement on account of an elastic deformation when the force exceeds the threshold value in the holding position.

In particular, the projection and/or the elevation is pushed away elastically. The elastic deformation can take place on the cam and/or a wall section of the base body. This can be referred to for example as through-latching. This has the advantage that a cost-effective solution can be provided. The elevations and the projection preferably consist of plastic.

According to a further embodiment, the contour comprises a second elevation, which presses against the projection and prevents a rotation of the holding device in the direction of the holding position when the holding device is in the upwardly folded position.

This has the advantage that three positions of the holding element can be realized with the aid of a contour. The first and the second elevation are preferably embodied on the cam. In particular, the second elevation forms a lower resistance than the first elevation when said elevations press against the projection.

According to a further embodiment, the base body has a base section and a wall section which is connected to the base section, wherein the holding device is mounted on the wall section.

The wall section and the base section preferably form an L shape. In particular, the base section comprises an outer ring section, in which an inner ring section is arranged with the aid of webs. Three webs preferably extend radially from the inner ring section to the outer ring section. In particular, the inner ring section complete with webs can also be referred to as a funnel. The webs preferably form a three-point support for the container. The container can thus be stabilized and positioned. This advantageously makes it possible to provide a positioning aid which can center and/or support containers with different diameters.

According to a further embodiment, a first connecting element is provided on an underside of the base section and can be connected to a base of the dish basket.

The first connecting element is preferably a latching element. In particular, the latching element and the base of the dish basket form a releasable latching connection. The latching element preferably latches to a base wire, in particular to a depth wire, of the dish basket. This has the advantage that the container holder can be connected securely to the base of the dish basket.

According to a further embodiment, a second connecting element is provided on the wall section and can be connected to a wall of the dish basket.

The second connecting element is in particular a latching element. The latching element and the wall of the dish basket preferably form a releasable latching connection. The latching element preferably latches to a wall wire, in particular to a depth wire of the dish basket. This advantageously enables the container holder to be connected securely to the wall of the dish basket.

According to a further embodiment, the second connecting element is provided at a first height and a third connecting element at a second height on the wall section, wherein the third connecting element can be connected to the wall of the dish basket.

The third connecting element is preferably a latching element. Advantageously, two connecting elements are thus embodied on the wall section so that the wall section can be fastened to different dish basket variants. A universal container holder is provided as a result.

According to a further embodiment, the base body has a first support element and a second support element, which are designed to engage into the dish basket in order to prevent a displacement of the container holder in a horizontal direction.

In particular, the support elements are configured as support flanks. The support elements are preferably embodied as two lugs pointing in opposite directions. In particular, the support elements comprise in each case a curved support surface for a wire of the dish basket, in particular a transverse wire. In particular, the support elements are embodied in each case as a lug latch. The wall section of the base body comprises for example a third support element and a fourth support element, which engage into the dish basket in order to prevent a displacement of the wall section of the base body in a horizontal direction.

The third and fourth support element are preferably embodied as two lugs pointing in opposite directions.

Also provided is a dish basket for a household dishwasher with a container holder as described above.

The dish basket is preferably embodied as a basket structure, which is formed in particular with the aid of wires. The basket structure comprises for example a base, in particular a wire mat, and, in particular four, side walls molded onto the base. The basket structure comprises a loading opening through which dishware, in particular plates and containers, can be guided into the basket structure for the purpose of washing the dishware.

Also provided is a household dishwasher with a container holder as described above or a dish basket as described above.

The embodiments described in relation to the container holder apply accordingly to the dish basket and the household dishwasher.

Further possible implementations of the invention also include combinations of features or embodiments described above or below with regard to exemplary embodiments, even if these combinations are not mentioned explicitly. A person skilled in the art will also add individual aspects as improvements or additions to the relevant basic form of the invention.

BRIEF DESCRIPTION OF THE DRAWINGS

Further advantageous embodiments and aspects of the invention form the subject matter of the dependent claims and of the exemplary embodiments of the invention that are described below. The invention is described in greater detail below using preferred embodiments with reference to the accompanying figures,
in which:

DETAILED DESCRIPTION OF EXEMPLARY EMBODIMENTS OF THE PRESENT INVENTION

Figure 1:
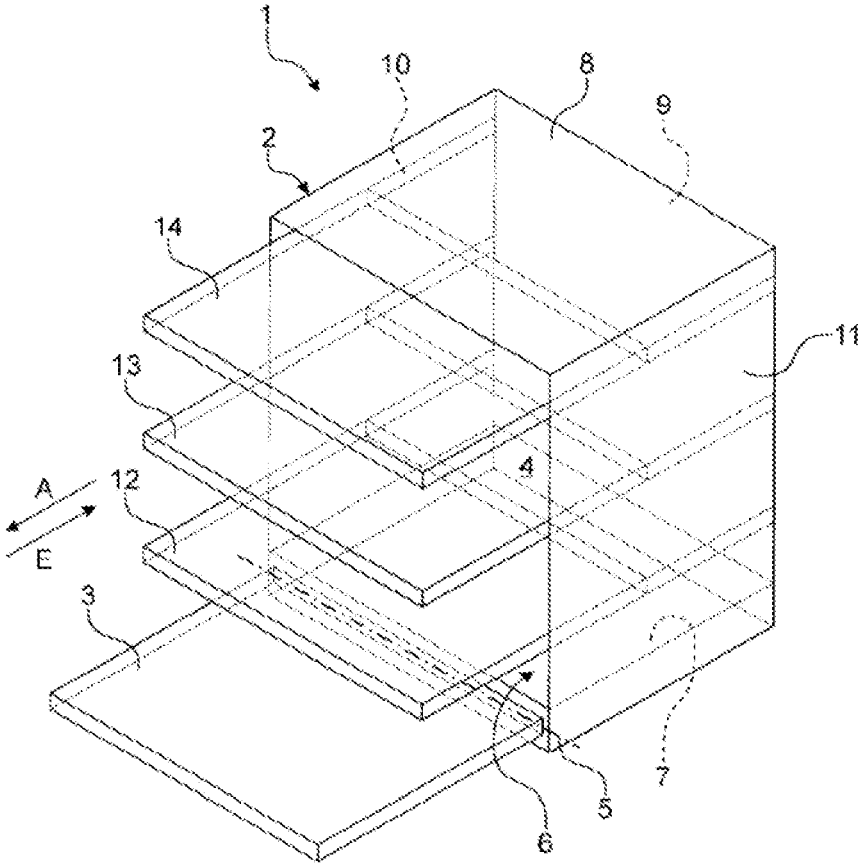
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed off by a door 3, in particular in a watertight manner. A sealing device can be provided for this purpose between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged opposite to the base 7, a rear wall 9 arranged facing the closed door, 3 and two side walls 10, 11 arranged facing one another. The base 7, the ceiling 8, the rear wall 9 and the side walls 10, 11 can be manufactured from a stainless-steel sheet, for example. Alternatively, the base 7 can be manufactured from a plastic material, for example.

The household dishwasher 1 also has at least one receptacle for items to be washed 12 to 14. A number of, for instance three, receptacles for items to be washed 12 to 14 can preferably be provided, wherein the receptacle for items to be washed 12 can be a lower receptacle for items to be washed or a bottom basket, the receptacle for items to be washed 13 can be an upper receptacle for items to be washed or an upper basket, and the receptacle for items to be washed 14 can be a cutlery drawer. As additionally shown in FIG. 1, the receptacles for items to be washed 12 to 14 are arranged one above the other in the dishwasher cavity 2. Each receptacle for items to be washed 12 to 14 is optionally able to be shifted into or out of the dishwasher cavity 2. In particular, each receptacle for items to be washed 12 to 14 can be inserted or moved into the dishwasher cavity 2 in an insertion direction E (arrow) and extracted or moved out from the dishwasher cavity 2 against the insertion direction E (arrow) in an extraction direction A (arrow).

Figure 2:
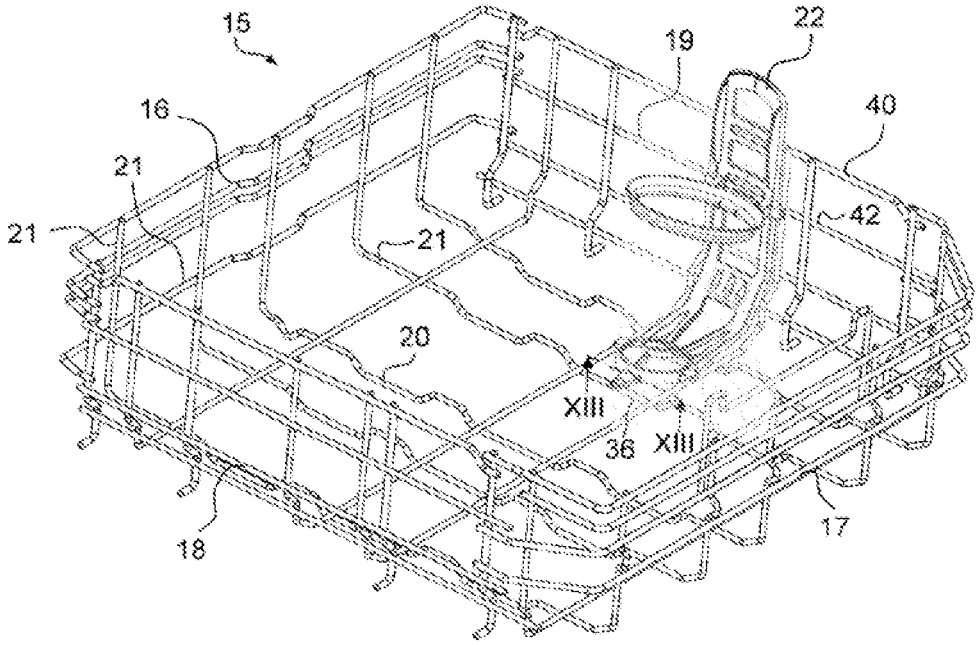
FIG. 2 shows a schematic perspective view of an embodiment of a dish basket for the household dishwasher according to FIG. 1.

FIG. 2 shows a perspective view of a dish basket 15. The dish basket 15 is embodied as a receptacle for items to be washed 12 (see FIG. 1). The dish basket 15 has two side walls 16, 17 arranged opposite each other. Furthermore, the dish basket 15 has two side walls 18, 19, which are arranged opposite one another and extend at right angles to the side walls 16, 17. The side walls 16, 17, 18, 19 are connected to one another in the shape of a frame.

Furthermore, the dish basket 15 has a base 20, in particular a wire mat, which preferably extends at right angles to the side walls 16, 17, 18, 19. The base 20 and the side walls 16, 17, 18, 19 are formed from bent wires 21 and form a basket structure. Also provided is a container holder 22, which is connected releasably at least to the base 20 and/or to the side wall 19. The container holder 22 is for example a bottle holder. The container holder 22 is designed to hold a container, in particular a bottle, a flask, a decanter, etc., during a wash cycle.

Figure 3:
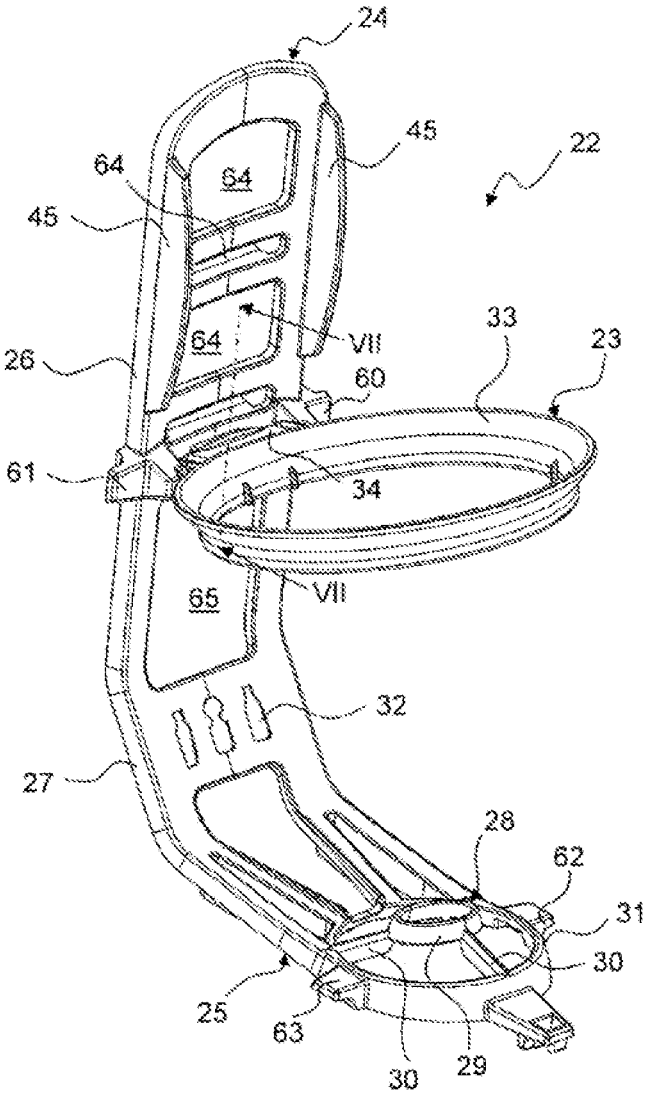
FIG. 3 shows a schematic perspective view of an embodiment of a container holder for the dish basket according to FIG. 2.

FIG. 3 shows a perspective view of the container holder 22. The container holder 22 comprises a holding device 23, which is designed to surround the container at least partially. The container holder 22 also has a base body 24, on which the holding device 23 is rotatably mounted. The base body 24 comprises a base section 25 and a wall section 26 which is connected to the base section 25. The base section 25 and the wall section 26 extend essentially at right angles to one another, for example. The base section 25 and the wall section 26 are preferably connected to one another with the aid of a transition section 27. The transition section 27 is embodied as a flat area.

The transition section 27 is embodied at an angle to the wall section 26 and at an angle to the base section 25. The base section 25, the transition section 27 and the wall section 26 form an L shape. The holding device 23 is mounted on the wall section 26. A centering element 28 projects upward from the base section 25. The centering element 28 is designed to center a container and/or support it on the opening side. Here, the centering element 28 projects into an opening of the container for example. In such a case, the container is standing for example upside-down in the container holder 22.

The centering element 28 comprises for example an inner ring section 29, from which webs 30 project and connect it to an outer ring section 31 of the base section 25. Preferably, three webs 30 are connected to the ring section 29 and project radially from the ring section 29. In particular, the centering element 28 is designed to allow water coming from below to flow into the container. If for example three webs 30 are embodied, the base 25 forms a three-point support for the container. Containers with different opening diameters can be supported with the aid of the webs 30. In particular, the centering element 28 can be referred to as a base-side funnel and/or as a positioning aid for the container.

In particular, container representations 32 are embodied in the transition section 27, in particular embossed, stamped in or cut out. Three container representations 32 are preferably embodied on the transition section 27, in particular a decanter, a sports bottle and a drinking bottle. This has the advantage that the container representations 32 cannot be washed off. Here, a user receives a suitable indication as to the intended use of the container holder 22. In particular, the holding device 23 has a ring element 33 and a fastening element 34. The ring element is designed to at least partially surround, to center and/or to fix the container. The holding device 23 is connected to the wall section 26 with the aid of the fastening element 34.

Figure 4:
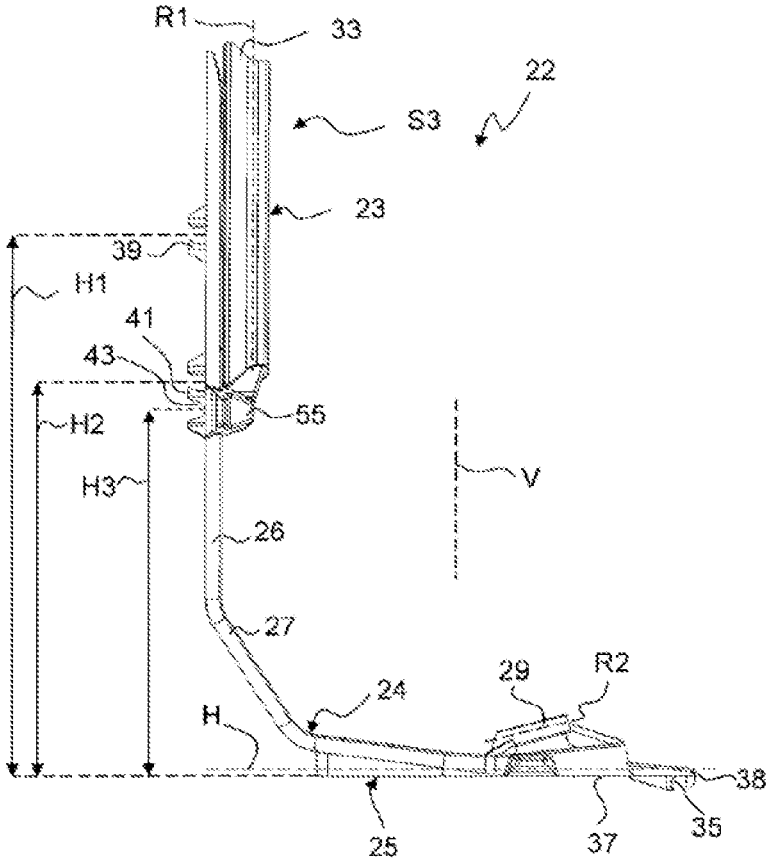
FIG. 4 shows a side view of the container holder from FIG. 3.

FIG. 4 shows a side view of the container holder 22. Here, the holding device 23 has an upwardly folded position S3. In this position, the ring element 33 rests on the wall section 26. The ring element 33 is preferably pretensioned against the wall section 26. This has the advantage that an undesired folding down of the ring element 33 can be prevented. The upwardly folded position S3 has the advantage that the container holder 22 can be arranged in a space-saving manner inside the dish basket 15 if for example no container is arranged inside the container holder 22.

A ring plane R1 of the ring element 33 preferably extends parallel to the wall section 26. Here, the ring element 33 has a vertical position. The ring section 29 comprises a ring plane R2. In particular, the ring plane R2 is inclined relative to a horizontal H. This inclination makes it possible for example for a container to be positioned inclined relative to a vertical V in the container holder 22. In particular, the base section 25 comprises a connecting element 35. The connecting element 35 is designed to connect the container holder 22 to the basket base 20, in particular to a base wire 36 (see FIG. 2). Here, the base wire 36 can be a depth wire. The connecting element 35 is preferably arranged on an underside 37 of the base section 25.

The connecting element 35 is in particular a clip connection. The clip connection is designed to be pressed onto the base wire 36, undergo elastic deformation in the process, and then surround the base wire 36 in a form-fit manner. As a result, the container holder 22 can be connected releasably to the base 20 of the dish basket 15 (see FIG. 2). Here, the connecting element 35 is embodied at a tip 38 of the base section 25 facing away from the wall section 26. This ensures a stable fastening of the container holder 22 to the basket base 20 (see FIG. 2).

The connecting element 35 can also be referred to as a latching element (here also as the first latching element), which is designed to latch to the base 20 of the dish basket 15. In particular, the wall section 26 comprises a connecting element 39, in particular a latching element (here also referred to as the second latching element), which is designed to latch to the wall 19 of the dish basket 15 (see FIG. 2). The connecting element 39 is in particular designed to be connected to a horizontally extending wire 40, preferably a depth wire, of the wall 19. In particular, the connecting element 39 is embodied at a first height H1 on the wall section 26. A further connecting element 41, in particular a latching element (here also referred to as the third latching element) is preferably provided at a second height H2. The connecting element 41 is designed to latch to the wall 19 of the dish basket 15 (see FIG. 2). The connecting element 41 is for example embodied to be identical to the connecting element 39.

Providing two connecting elements 39, 41 at different heights with respect to the underside 37 of the base section 25 has the advantage that the container holder 22 can be connected to different dish baskets 15. The container holder 22 can thus be used universally. Furthermore, a guide element 43 can be provided in order to receive a wire 42 (see FIG. 2) in sections. The guide element 43 can also be referred to as a recess and serves to further stabilize the container holder 22 on the dish basket 15. Here, the height H3 is for example smaller than the height H2 and the height H1.

Figure 5:
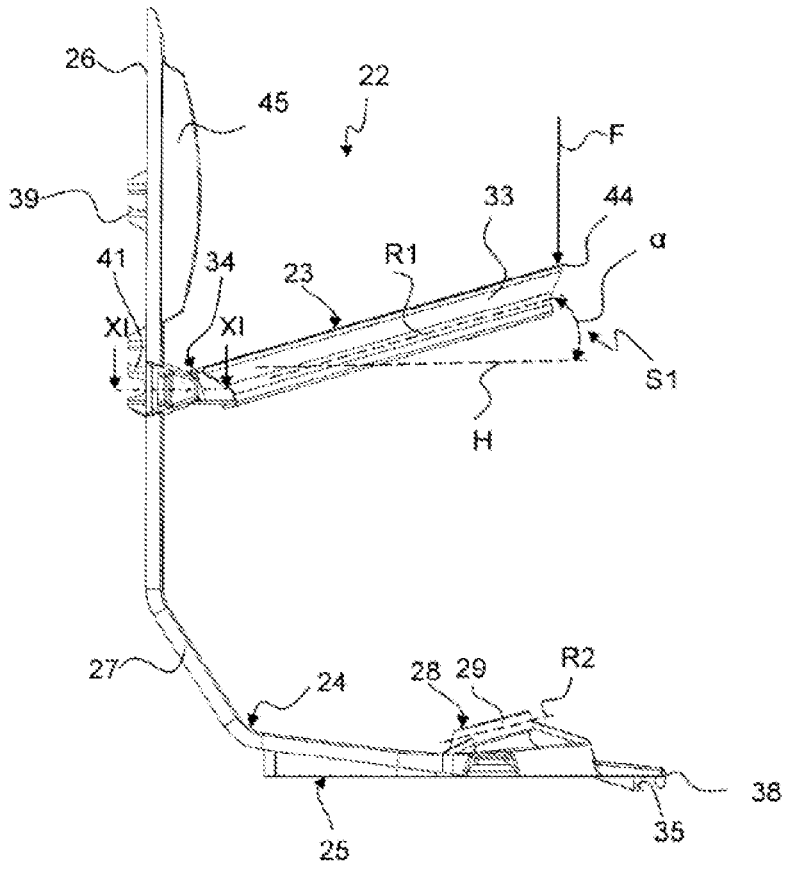
FIG. 5 shows a side view of the container holder from FIG. 3.

FIG. 5 shows a further side view of the container holder 22. Here, the holding device 23 is shown in a holding position S1. In this position, the holding device 23 is designed to hold the container for a wash cycle. Here, the ring plane R1 extends at an angle $\alpha$ (double arrow) to the horizontal H. Alternatively, the ring plane R1 can also extend horizontally in this position. The angle $\alpha$ (double arrow) is preferably between 3° and 30°, 5° and 25°, 10° and 20°, 12° and 18° or 14° and 16°. The angle $\alpha$ (double arrow) is preferably also embodied between the ring plane R2 and the horizontal H. In particular, the ring element 33 and the ring section 29 thus have the same inclination in the holding position. Here, the angle $\alpha$ (double arrow) is preferably positive, so that the ring element 33 is inclined slightly upward.

The holding device 23 is designed, when a vertical, downwardly directed force F (arrow) is exerted thereon, to move out from the holding position S1 into an inclined position S2 (see FIG. 6) when the force F (arrow) exceeds a threshold value. This has the advantage that an overloading of the holding device 23 can be avoided. As a result, a protective mechanism can be realized to prevent damage to the container holder 22. The container holder 22 is preferably formed from plastic. The force F (arrow) is preferably applied to an outermost free end 44 of the ring element 33. This results in the greatest possible lever on the fastening element 34. The force F (arrow) preferably amounts to between 2 and 100 N, 2 and 50 N, 3 and 30 N or 5 and 20 N. The force can also be applied to another point of the ring segment, wherein the threshold value is then greater on account of the smaller lever.

Furthermore, ribs 45 are embodied on the wall section 26 (see also FIG. 3). The ribs face toward the ring element 33. In particular, two parallel ribs 45 are embodied. The ribs 45 can be embodied for example as positioning aids for the container. There is preferably space between the two positioning aids 45 to receive a part of the container, in particular a base section of the container and/or a base-side wall section of the container. The ribs 45 make it easier to slide the container between the ribs 45 and then form an obstacle to prevent it from sliding out. The container can be positioned and stabilized with the aid of the centering element 28 and the ribs 45, for example. Alternatively or in addition, the ribs 45 can also be embodied as support elements for the ring element 33 in the upwardly folded position S3 in order to stabilize the same.

As shown further in FIG. 3, the wall section 26 comprises windows 64, which are provided between the ribs 45 and serve as a further positioning aid. In particular, three windows 64 are embodied, which are preferably arranged one above the other and can each have different shapes. Below the holding device 23, provision can be made on the wall section 26 for a further window 65, which can serve as a positioning aid for shorter or small containers.

Figure 6:
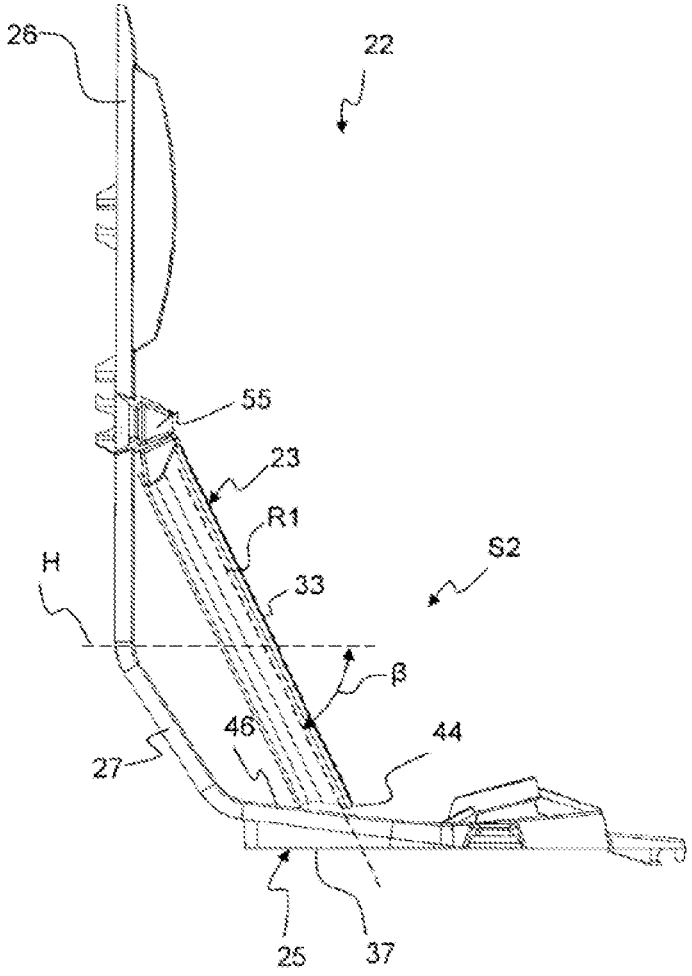
FIG. 6 shows a side view of the container holder from FIG. 3.

FIG. 6 shows a further side view of the container holder 22, wherein the holding device 23 is in an inclined position S2. The holding device 23 assumes this position when the force F (arrow) (see FIG. 5) exceeds the threshold value. This position can preferably be referred to as the through-latching position. Here, the ring element 33 rests on a top side 46 of the base section 25. In particular, the end 44 points toward the base section 25. The ring plane R1 now forms an angle β (double arrow) with the horizontal H. Here, the angle β (double arrow) is negative.

Figure 7:
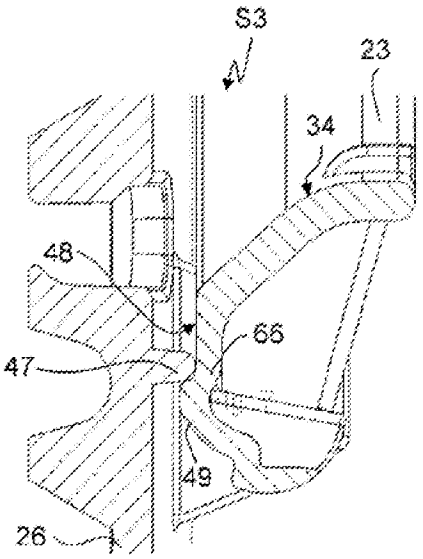
FIG. 7 shows the section VII-VII from FIG. 3 for a position shown in FIG. 4.

FIG. 7 shows section VII-VII from FIG. 3, wherein the holding device 23 has the upwardly folded position S3 (see FIG. 4). The wall section 26 has a projection 47. Here, the projection 47 projects from the wall section 26 to the holding device 23. The fastening element 34 comprises a cam 66 with a contour 48, wherein the contour 48 slides at least in sections over the projection 47 when the holding device 23 is rotated relative to the wall section 26. The contour 48 preferably comprises an elevation 49 (also referred to here as the second elevation), which presses against the projection 47 in order to prevent a rotation of the holding device 23 in the direction of the holding position S1 when the holding device 23 is in the upwardly folded position S3. In particular, the pressing can also be a light resting.

Figure 8:
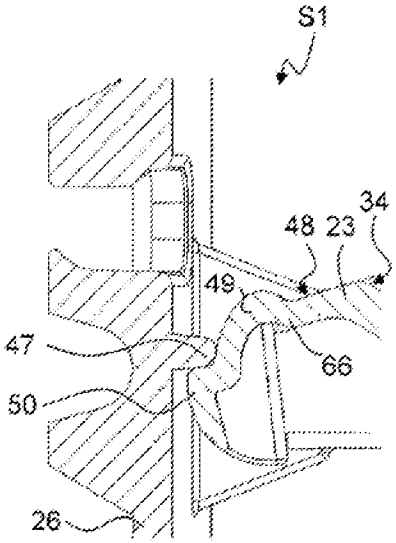
FIG. 8 shows the section VII-VII from FIG. 3 for a position shown in FIG. 5.

In contrast to FIG. 7, in FIG. 8 the holding device 23 is in the holding position S1. The contour 48 comprises an elevation 50 (also referred to here as the first elevation), which presses against the projection 47 and prevents a rotation of the holding device 23 in the direction of the inclined position S2 (see FIG. 9). Here, the holding device 23 and the wall section 26 are designed in such a way that the projection 47 and the elevation 50 are pressed away from one another and/or are elastically deformed when the force F (arrow) exceeds the threshold value. Here, the wall section 26 and the contour 48 perform an evasive movement, so that the holding device 23 moves into the inclined position S2.

Figure 9:
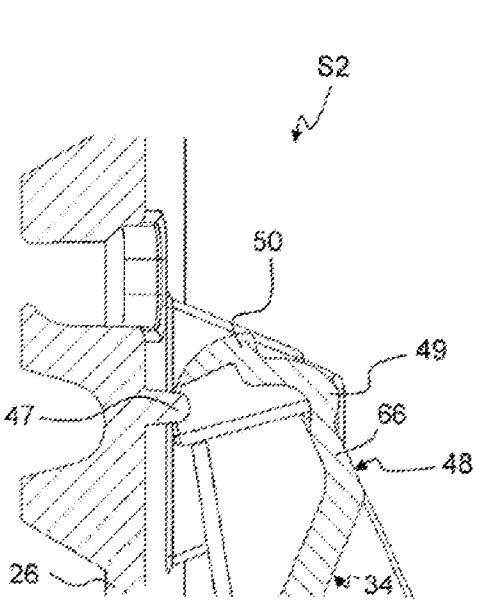
FIG. 9 shows the section VII-VII from FIG. 3 for a position shown in FIG. 6.

In contrast to FIG. 8, in FIG. 9 the holding device 23 is in the inclined position S2. The contour 48 is no longer in contact with the projection 47. When a user moves the holding device 23 into the holding position S1, then a resistance must be overcome so that the elevation 50 and the projection 47 perform a further evasive movement. Here, the evasive movement is elastic. The contour 48 is curved in an arc-shaped manner and has a corrugated shape in order to embody the elevations 49, 50. The elevation 50 is embodied on an end section of the connecting element 34.

Figure 10:
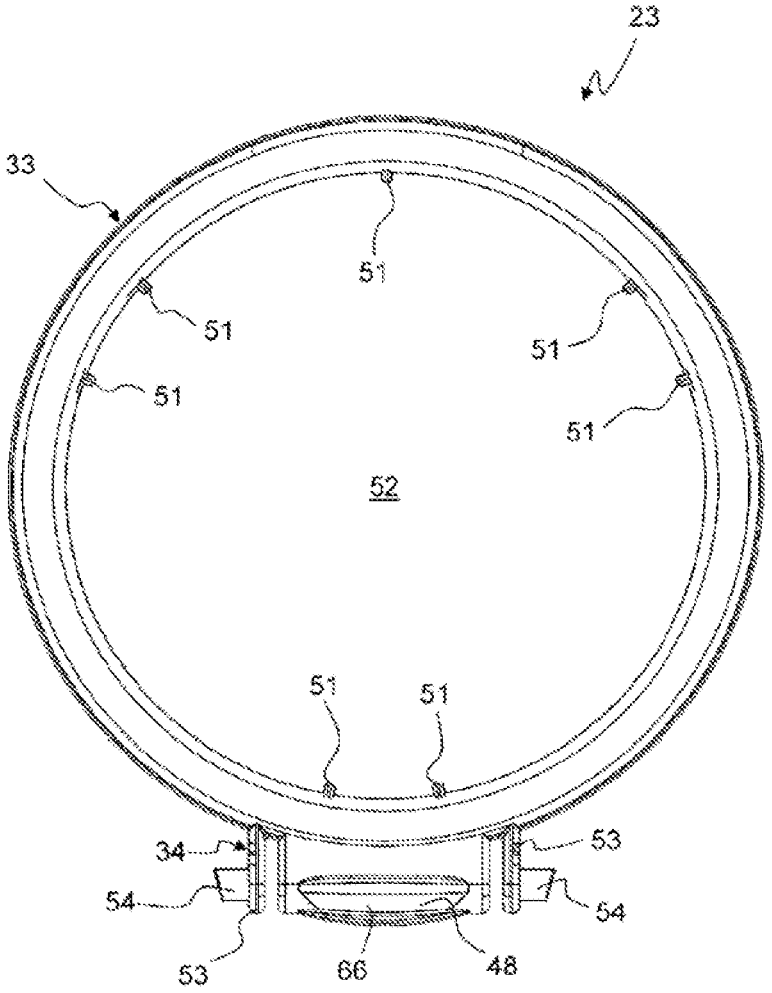
FIG. 10 shows a top view of a holding device of the container holder from FIG. 3.

FIG. 10 shows the holding device 23 in a top view. The ring element 33 comprises projections 51. The projections 51 extend radially inward. The ring section 33 surrounds an opening 52. The ring element 33 is embodied as a fully closed ring, for example. Alternatively, the ring element 33 can also be embodied as an open ring. In particular, the ring element 33 can also be embodied as a ring segment. The container can be guided through the opening 52 in order to be placed in the container holder 22. Here, the container can rest on the projections 51, so that point supports are embodied. The projections 51 are distributed along an inner circumference of the ring element 33. Furthermore, the connecting element 34 preferably has two web sections 53, on which bearing journals 54 are embodied. In particular, two bearing journals 54 which project away from one another are embodied. The cam 66 is embodied between the web sections 53.

Figure 11:
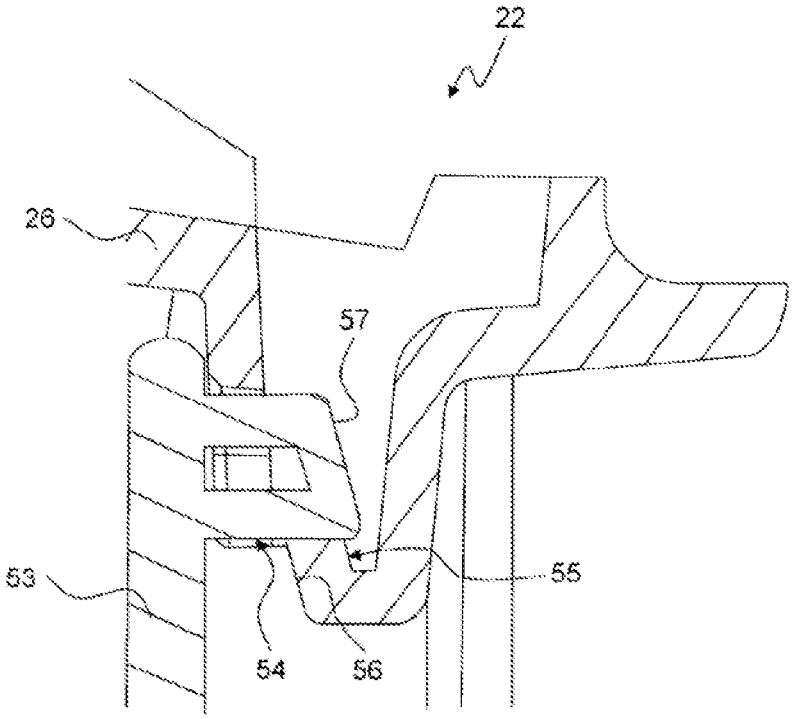
FIG. 11 shows the section XI-XI from FIG. 5.

FIG. 11 shows section XI-XI from FIG. 5. Here, this section is shown as a partial section. For each bearing journal 54, the wall section 26 comprises a bearing 55. The bearing 55 is designed to support the bearing journal 54 in a rotational manner. Furthermore, the bearing 55 has an inclined insertion surface 56. The bearing journal 54 also comprises an inclined insertion surface 57. Advantageously, the inclined insertion surfaces 56 and 57, when the bearing journal 54 is inserted into the bearing 55, interact in such a way that the web section 53 is pressed outward so that subsequently the bearing journal 54 can snap into the bearing 55.

Figure 12:
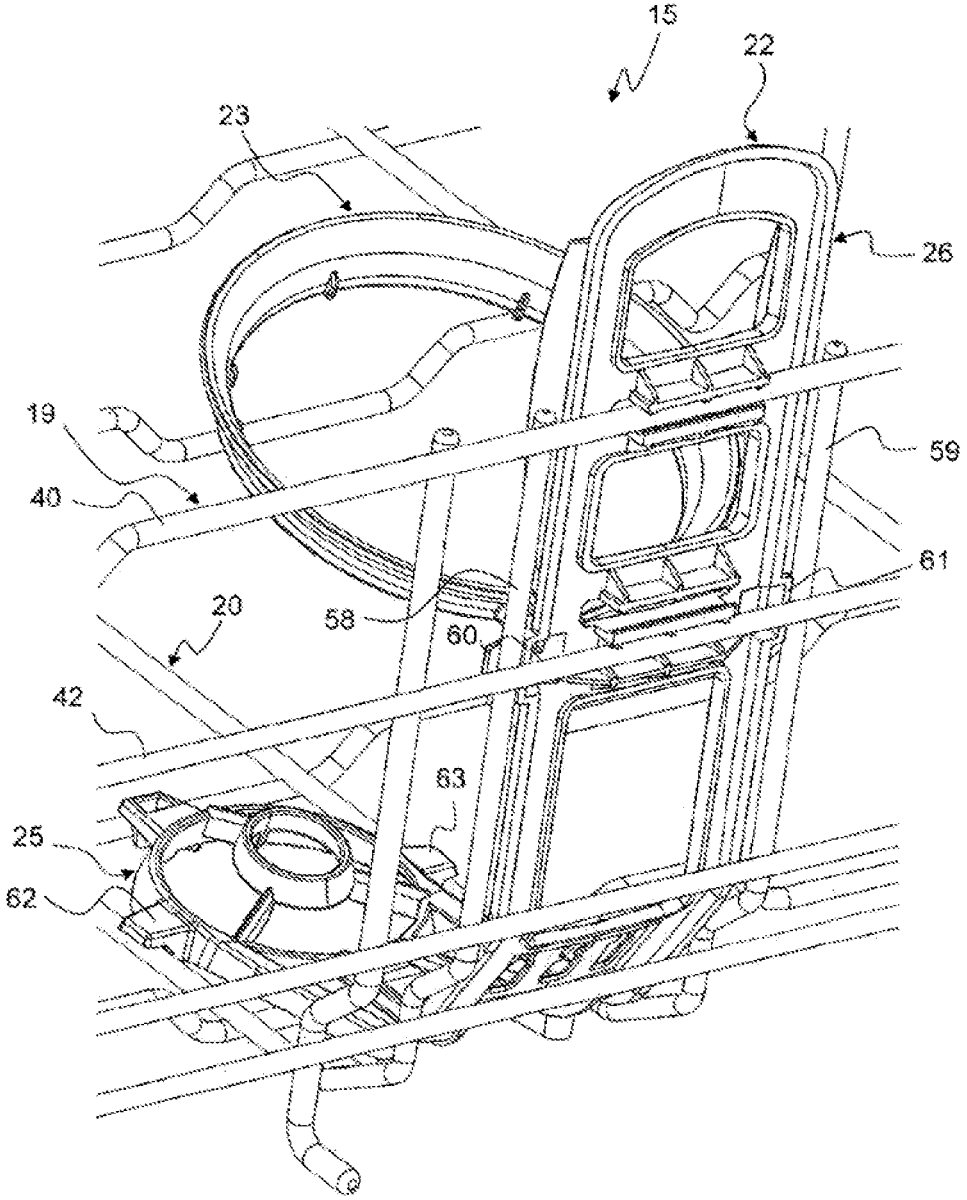
FIG. 12 shows a schematic perspective partial view of the dish basket from FIG. 2.

FIG. 12 shows a further schematic perspective representation of the dish basket 15 with the container holder 22. The dish basket 15 comprises a transverse wire 58 and a transverse wire 59 adjacent thereto, which are embodied to be bent so that they extend from the side wall 19 into the base 20. Here, the transverse wires 58, 59 are directly adjacent to one another. The wall section 26 is arranged between the transverse wire 58 and the transverse wire 59. The wall section 26 comprises a support element 60, which rests on the transverse wire 58. The wall section 26 further has a support element 61, which rests on the transverse wire 59. The wall section 26 is mounted between the transverse wires 58, 59 with the aid of the support elements 60, 61. The wall section 26 is thus fixed in an axial direction. The base section 25 can also comprise support elements 62 and 63, for example.

Figure 13:
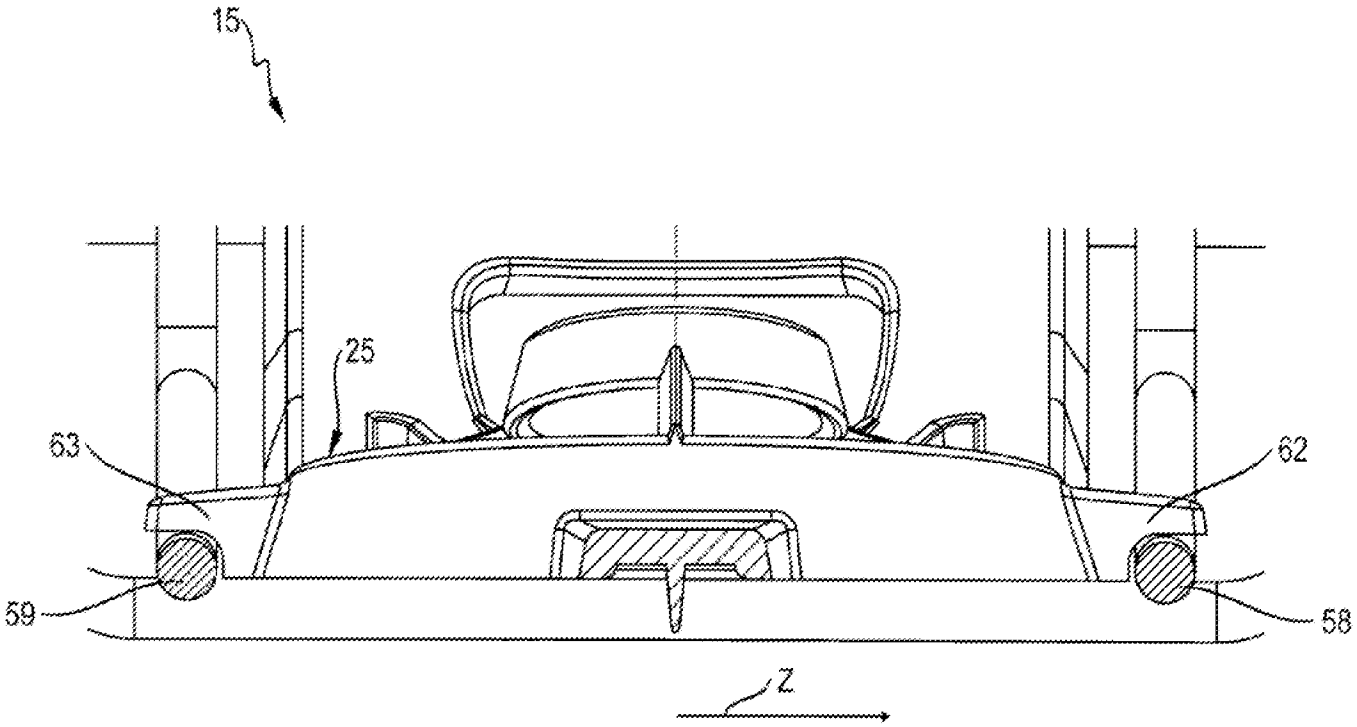
FIG. 13 shows the section XIII-XIII from FIG. 2.

FIG. 13 shows section XIII-XIII from FIG. 2. The support elements 62, 63 of the base section 25 are designed to fix the base section 25 between the transverse wire 58 and the transverse wire 59. Here, the base section 25 is fixed downwardly and to the side. The support elements 62, 63 are embodied to have an L shape, for example. The support elements 62, 63 can also be referred to as lugs which point in opposite directions. The support elements 60, 61 (see FIG. 12) can for example also be referred to as lugs which point in opposite directions. Advantageously, a stable fixing between the transverse wires 58, 59 and the container holder 22 can be realized with the aid of the support elements 60, 61, 62, 63. The support elements 60, 61, 62, 63 are designed to engage into the dish basket 15 in order to prevent a displacement of the container holder 22 in a horizontal direction Z (arrow), which runs at right angles to the transverse wires 58, 59.

Although the present invention has been described with reference to exemplary embodiments, it can be modified in numerous different ways.

The invention claimed is:

1. A container holder for a dish basket of a household dishwasher, said container holder comprising:

a holding device, which has a holding position for holding a container and a downwardly inclined position relative to the container, said holding device being designed to move out from the holding position into the inclined position when a vertical, downwardly directed force is exerted on the holding device and exceeds a threshold value;

a base body comprising a base section and a wall section coupled to the base section, the holding device being mounted on the wall section;

a first connecting element provided on an underside of the base section and releasably connected to a horizontal base of the dish basket; and a second connecting element provided on the wall section and releasably connected to a side wall of the dish basket.

2. The container holder of claim 1, wherein the holding device is rotatably mounted on the base body.

3. The container holder of claim 1, wherein the holding device has an upwardly folded position relative to the holding position.

4. The container holder of claim 3, wherein the holding device is pretensioned in the upwardly folded position.

5. The container holder of claim 3, wherein the holding device is pretensioned against the base body in the upwardly folded position.

6. The container holder of claim 2, wherein the base body has a projection, said holding device having a contour which has at least one section that slides over the projection when the holding device rotates relative to the base body.

7. The container holder of claim 6, wherein the contour comprises a first elevation, which presses against the projection and prevents a rotation of the holding device in a direction of the inclined position when the holding device is in the holding position and the force is below the threshold value.

8. The container holder of claim 7, wherein the holding device and the base body are designed in such a way that the projection and/or the first elevation performs an evasive movement on account of an elastic deformation when the force exceeds the threshold value in the holding position.

9. The container holder of claim 7, wherein the contour comprises a second elevation, which presses against the projection and prevents a rotation of the holding device in a direction of the holding position when the holding device is in an upwardly folded position relative to the holding position.

10. The container holder of claim 1, wherein the second connecting element is provided at a first height on the wall section, and further comprising a third connecting element provided on the wall section at a second height for connection to the side wall of the dish basket.

11. The container holder of claim 2, wherein the base body comprises a first support element and a second support element, said first and second support elements designed to engage into the dish basket in order to prevent a displacement of the container holder in a horizontal direction.

12. A dish basket for a household dishwasher, said dish basket comprising:

a horizontal base;

a side wall attached to the horizontal base; and a container holder comprising:

a holding device, said holding device having a holding position for holding a container and a downwardly inclined position relative to the container, said holding device being designed to move out from the holding position into the inclined position when a vertical, downwardly directed force is exerted on the holding device and exceeds a threshold value;

a base body comprising a base section and a wall section coupled to the base section, the holding device being mounted on the wall section;

a first connecting element provided on an underside of the base section and releasably connected to the horizontal base of the dish basket; and a second connecting element provided on the wall section and releasably connected to the side wall of the dish basket.

13. A household dishwasher, comprising a container holder or a dish basket comprising said container holder, said container holder comprising:

a holding device which has a holding position for holding a container and a downwardly inclined position relative to the container, said holding device being designed to move out from the holding position into the inclined position when a vertical, downwardly directed force is exerted on the holding device and exceeds a threshold value;

a base body comprising a base section and a wall section coupled to the base section, the holding device being mounted on the wall section;

a first connecting element provided on an underside of the base section and releasably connected to a horizontal base of the dish basket; and a second connecting element provided on the wall section and releasably connected to a side wall of the dish basket.

* * * * *